United States Patent [19]

Stetson et al.

[11] 4,061,068

[45] Dec. 6, 1977

[54] STRINGED INSTRUMENT WITH AN IMPROVED BACK PLATE CONSTRUCTION

[76] Inventors: Karl A. Stetson, R.F.D. 2, Box 182, South St., Coventry, Conn. 06238; Carl Hugo Ågren, Saturnusvagen 86, 184 00 Akersberga, Sweden

[21] Appl. No.: 641,447

[22] Filed: Dec. 17, 1975

[51] Int. Cl.[2] ..... G10D 1/02

[52] U.S. Cl. ..... 84/275

[58] Field of Search ..... 84/173, 267–268, 84/274–277, 284, 291

[56] References Cited

U.S. PATENT DOCUMENTS

| | | | |
|---|---|---|---|
| 322,925 | 7/1885 | Hall | 84/277 |
| 468,114 | 2/1892 | McNichol | 84/275 |
| 572,906 | 12/1896 | McNichol | 84/275 |
| 1,413,916 | 4/1922 | Kincannon | 84/275 X |
| 2,489,169 | 11/1949 | Virzi | 84/275 |

FOREIGN PATENT DOCUMENTS

| | | | |
|---|---|---|---|
| 1,334,728 | 9/1962 | France | 84/275 |

*Primary Examiner*—Lawrence R. Franklin
*Attorney, Agent, or Firm*—Krass & Young

[57] ABSTRACT

A violin, as representative of any of the members of the viol and violin families, has a soundbox with an improved back plate construction. The back plate is substantially flat and has affixed to it braces for resonance balancing with the top plate. The braces include an elongate, primary brace disposed parallel to the longitudinal axis of the back plate, and first and second sets of secondary braces which are longitudinally spaced from each other. Each set of secondary braces comprises a pair of short, brace segments which are laterally disposed on the other side of the primary brace and in oppositely registering positions with respect thereto.

10 Claims, 3 Drawing Figures

STRINGED INSTRUMENT WITH AN IMPROVED BACK PLATE CONSTRUCTION

INTRODUCTION

This invention relates to stringed instruments and more particularly to an improved back plate construction for the soundbox of such instruments.

BACKGROUND OF THE INVENTION

The excellence of a stringed instrument is largely measured by its loudness and number of resonances or harmonics over its entire range. A quality instrument will speak very easily when bowed and perform delicate pianissimo nuances with the same ease as forte passages.

In any high quality instrument of this type there is a careful balancing of the resonances of the top and back plates of the soundbox. Toward this effect, it is an object of the present invention to design a soundbox that will give improved performance over the conventional designs heretofore known, and yet be simple enough so as to be readily manufacturable and easily tuned.

BRIEF SUMMARY OF THE INVENTION

The present invention is an improved design for the soundbox of stringed instruments, most suitably members of the viol and violin families. The improved design heightens the number of resonances, as well as the magnitude of the loudness over the entire range of the instrument.

Basically this is accomplished by substituting for the conventional arched back plate of the soundbox a substantially flat back plate having braces attached thereon. The braces include a primary brace disposed parallel to the longitudinal axis of the soundbox, and secondary braces disposed laterally of the primary brace and at an acute angle with respect thereto.

This back plate design makes it possible to achieve a balancing of the resonances between the top and back plates with greater ease and reproducibility than heretofore possible with conventional arched back designs. The result is a greater degree of cooperation between the two plates and the body resonances of the entire instrument, especially the very important lowest resonances. This facilitates the mechanical coupling between the strings of the instrument and the body by lowering the mechanical impedance of the body at the feet of the instrument bridge. The overall effect is increased loudness and improved bowing characteristics.

DETAILED DESCRIPTION OF THE SPECIFIC EMBODIMENT

Figure 1:
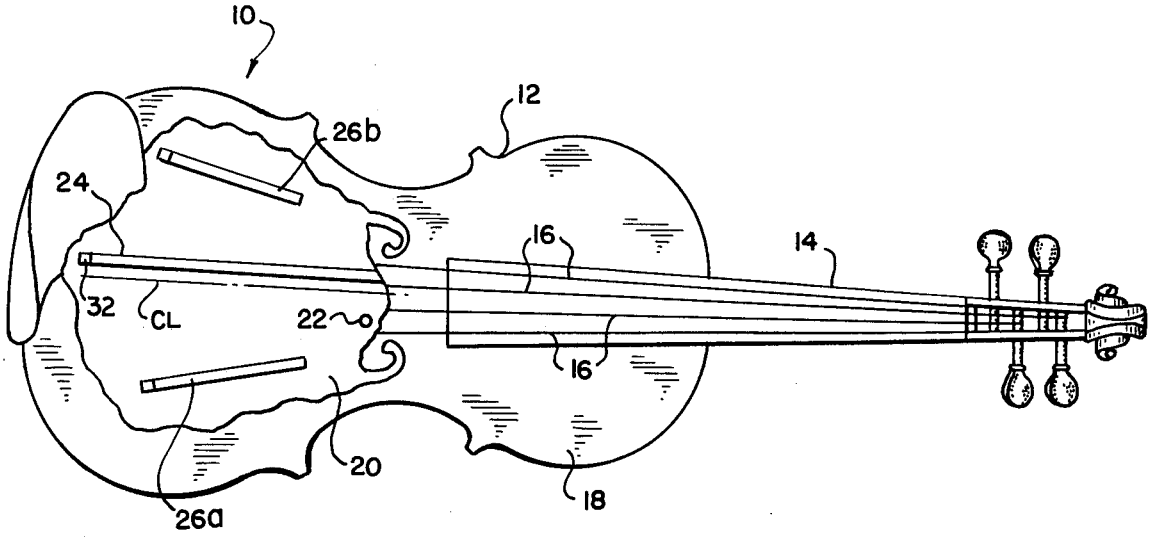
FIG. 1 is a plan view, partially cut away, of a violin embodying the present invention.

With reference to FIG. 1, a violin embodying the present invention is shown generally at 10. The illustration of a violin is only representative of all the members of the viol and violin families to which the invention is adaptable.

The violin 10 basically includes a soundbox 12, fingerboard 14, and a plurality of strings 16 which are extended under tension between points on the lower portion of the soundbox and the upper portion of the fingerboard by conventional means appurtenant thereto.

The soundbox 12 is a hollow, substantially closed wooden body which includes a top plate or sound board 18, a back plate 20, and a closed sidewall (not shown) joining the borders of the sound board and back plate. The sound board 18 is acoustically coupled to the back plate 20 by a sound post 22 frictionally fit therebetween.

Figure 2:
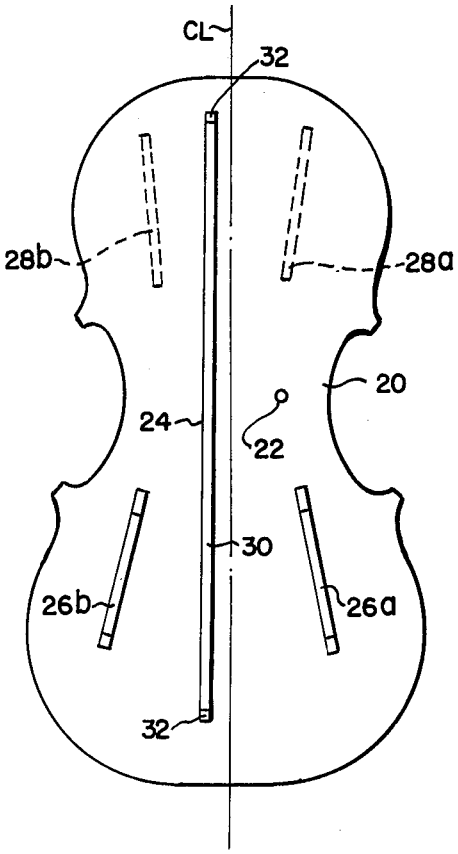
FIG. 2 is a front elevational view of a back plate isolated from the remainder of the violin.
Figure 3:
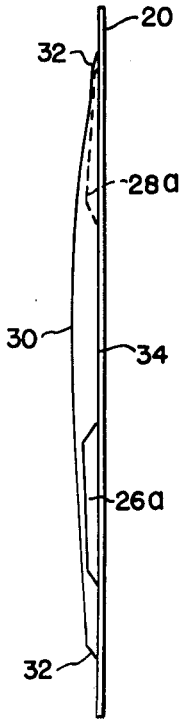
FIG. 3 is a side elevational view of the back plate of FIG. 2 which more clearly shows the profile of the bracing means attached thereto.

As seen in FIG. 3, the back plate 20 is substantially flat. Moreover, as seen partially in FIG. 1 and more fully in FIG. 2, the back plate 20 is braced for resonance balancing with the sound board 18. The back plate bracing means comprise a primary brace 24, a first set of secondary braces **26*a* and 26*b*, and a second set of optional, secondary braces 28*a* and 28*b***, whose use may or not be desired depending upon the side of the instrument body. They are generally omitted from the violin as indicated by the dashed lines in FIG. 2.

The primary brace 24 is an elongate, wooden member which is glued or otherwise secured to the inner face of the back plate 20. The primary brace 24 is disposed substantially parallel to the centerline CL of the violin 10. The amount which brace 24 is offset from centerline CL is a function of the resonant mechanical characteristics of the soundbox 12. As best seen in FIG. 3, primary brace 24, as well as secondary braces 26 and 28, each preferably have a slightly arched, central back segment 30, sharply tapered, extreme back segments 32, and a flat abutment surface 34.

The first set of secondary braces has members **26*a* and 26*b* disposed laterally and in oppositely registering positions with respect to primary brace 24. Secondary braces 26*a* and 26*b* are preferably at an acute, upwardly convergent angle between 0° and 30° with respect to the primary brace 24**.

The second set of secondary braces 28 is spaced longitudinally from the first set 26. The second set includes members **28*a* and 28*b* which are disposed laterally and in oppositely registering positions with respect to primary brace 24. To complement the first set of secondary braces 26*a* and 26*b*, the second set of secondary braces has members 28*a* and 28*b* at an acute, downwardly convergent angle between 0° and 30° with respect to primary brace 24. Both sets of secondary braces 26 and 28 may be secured to the inner face of back plate 20 in the same manner as the primary brace 24**.

By use of this bracing scheme the number of body resonances becomes very large, whereby the instrument body or soundbox 12 becomes a very efficient acoustical radiator, which is its intended function. Holographic interferometry has been used to measure and document the superiority in loudness and number of resonances of instruments embodying the present invention.

In accordance with the present invention, plate tuning, i.e., adjustment of plate thickness, bracing thickness and profiles, can be accomplished with either traditional, manual methods or modern, electronic methods. If tuned with a fiddle-maker's tap tone test, the back plate 20 is held loosely by the thumb and forefinger of one hand and tapped by knuckles or fingertips of the other hand, so that judgement of the plate tuning is done by ear. Alternatively, electronic methods can be employed such as those published by C. M. Hutchins and F. L. Fielding: Acoustical Measurements of Violins, Physics Today, July 1968, pp. 35–40; C. H. Ågren: Electrooptical Vibration Probe Using Integrated Circuits, Catgut Acoustical Society Newsletter, May 1973, pp. 10–12; and C. H. Ågren and K. A. Stetson: Measuring the Resonances of Treble Viol Plates by Hologram Interferometry and Designing an Improved Journal of the Acoustical Society of America, Vol. 51 no. 6 (part 2) 1972, pp. 1971–83.

As indicated, the invention is not limited to embodiment in a violin but is adaptable to all members of the viol and violin families. The advantages of the present invention over conventional back plate designs are manifold. Longitudinal bracing in accordance with the present invention tends to eliminate cracks which are common in cross-braced backs; manufacture is relatively simple; less wood is required than with arched-back plates; instrument properties are reproducible; high class instruments in small sizes (¾ violins, violas) are possible; loudness is increased (particularly with the viol family); and playing ease and dynamic range are great.

The embodiments of the invention in which an exclusive property or privilege is claimed are defined as follows:

1. In a violin or the like, an improved back plate construction for the soundbox, characterized by:

a substantially flat back plate having bracing means secured to its inner face, the bracing means comprising first and second lateral segments disposed in oppositely registering positions on opposed sides of a line of symmetry parallel to the longitudinal axia of the soundbox, and an elongated, longitudinal brace secured to the inner face of the back plate and disposed substantially collinear to the axis of symmetry.

2. A stringed instrument comprising:

a sound box for acoustical radiation, the sound box including a top plate, a flat back plate, a closed side wall, means for acoustically communicating the top and back plates, and bracing means affixed to the inner surface of the back plate, the bracing means including an elongate, primary brace having upper and lower ends and extending substantially parallel to the longitudinal axis of the soundbox, and first and second secondary braces laterally disposed in oppositely registering positions with respect to the primary brace;

a fingerboard attached to the soundboard and extending therefrom;

a plurality of tensile strings extending between points proximate the extreme ends of the soundbox and fingerboard, respectively; and, means for securing the strings under tension.

3. The stringed instrument as defined in claim 2 wherein the first and second secondary braces are disposed at an upwardly convergent, acute angle with respect to the longitudinal axis of the primary brace.

4. The stringed instrument as defined in claim 3, wherein the upwardly convergent, acute angle is between 0° and 30°.

5. The stringed instrument as defined in claim 2, wherein the primary brace is offset from the longitudinal axis of the soundbox.

6. The stringed instrument as defined in claim 2, wherein the means for acoustically communicating the top and back plates is a sound post frictionally fit therebetween.

7. The stringed instrument as defined in claim 2, further comprising, third and fourth secondary braces laterally disposed in oppositely registering positions with respect to the primary brace and spaced longitudinally from the first and second secondary braces, respectively.

8. The stringed instrument as defined in claim 7, wherein the third and fourth secondary braces are disposed at a downwardly convergent, acute angle with respect to the longitudinal axis of the primary brace.

9. The stringed instrument as defined in claim 8, wherein the downwardly convergent, acute angle is between 0° and 30°.

10. The stringed instrument of claim 7, wherein each brace is characterized by a flat abutment surface, an arched, central back segment, and sharply convergent, extreme back segments.

* * * * *